United States Patent [19]

Nipper et al.

[11] Patent Number: 4,989,265

[45] Date of Patent: Feb. 5, 1991

[54] PROTECTIVE ATHLETIC EQUIPMENT

[75] Inventors: Leonard O. Nipper; Donald E. Ettinger, both of Cookeville, Tenn.

[73] Assignee: Cassemco, Inc., Cookeville, Tenn.

[21] Appl. No.: 437,597

[22] Filed: Nov. 17, 1989

[51] Int. Cl.[5] ..... A41D 13/00

[52] U.S. Cl. ..... 2/2; 2/92; 2/267; 2/268

[58] Field of Search ..... 2/2, 2.5, 92, 267, 268, 2/24

[56] References Cited

U.S. PATENT DOCUMENTS

| | | | |
|---|---|---|---|
| 2,251,018 | 7/1941 | Lookabaugh | 2/2 |
| 2,636,170 | 4/1953 | Goldsmith | 2/2 |
| 2,741,767 | 4/1956 | Weeks | 2/2 |
| 2,990,549 | 7/1961 | Doughty | 2/2 |
| 3,158,871 | 12/1964 | Morgan | 2/2 |
| 3,528,106 | 9/1970 | Austin | 2/2 |
| 3,693,619 | 9/1972 | Williams | 2/24 |
| 3,710,391 | 1/1973 | McGlynn | 2/2 |
| 3,855,631 | 12/1974 | Ettinger | 2/2 |
| 4,100,620 | 7/1978 | Pecoraro | 2/2 |
| 4,135,252 | 1/1979 | Latina et al. | 2/2 |
| 4,158,242 | 6/1979 | Mitchell | 2/2 |
| 4,292,687 | 10/1981 | Daverport, Jr. | 2/2 |
| 4,332,633 | 6/1982 | Yamauchi et al. | 2/267 |
| 4,333,179 | 6/1982 | Laurita | 2/2 |
| 4,338,685 | 7/1982 | LaPorta, Jr. | 2/2 |
| 4,501,023 | 2/1985 | Bilberry | 2/2 |
| 4,525,875 | 7/1985 | Tomczak | 2/2 |
| 4,590,622 | 5/1986 | Wolfe et al. | 2/2 |
| 4,610,034 | 9/1986 | Johnson | 2/2.5 |
| 4,654,893 | 4/1987 | Meyers et al. | 2/2 |
| 4,698,845 | 10/1987 | Cosby | 2/2 |
| 4,766,614 | 8/1988 | Cantwell et al. | 2/414 |
| 4,807,303 | 2/1989 | Mann et al. | 2/69 |

FOREIGN PATENT DOCUMENTS

| | | | |
|---|---|---|---|
| 0083454 | 7/1983 | Fed. Rep. of Germany | 2/92 |
| 1034581 | 6/1966 | United Kingdom | 2/2 |
| 2177892 | 2/1987 | United Kingdom | 2/2 |

*Primary Examiner*—William A. Cuchlinski, Jr.
*Assistant Examiner*—Alvin Wirthlin
*Attorney, Agent, or Firm*—Barnes & Thornburg

[57] ABSTRACT

An article of protective athletic equipment to be worn by a person includes padding in the form of a layer of closed cell, elastomeric foam having a regularly bi-directionally convoluted surface for confronting the person. An exemplary shoulder pad using such padding has a chest protector including a substantially rigid, shape-retaining layer forming a back portion, and arch portion and a front portion including outside edges proximately overlying a vertical mid-line of each pectoralis major of the person so that forward motion of the arm is unrestricted by the chest protector. The outside edge of the chest protector extends downwardly and outwardly below the pectoralis major to provide protection for the ribs. Flexible pads are coupled to the shape-retaining portion to extend outwardly over the outer portion of the pectoralis major, the flexible pad being pivotable about the outside edge of the chest protector during movement of the shoulder. A shoulder joint cap having a padded inner portion and a substantially rigid outer portion is flexibly connected to an arch portion of the chest protector. A substantially rigid flap or epaulet is flexibly connected to the arch portion of the chest protector to overlie the chest protector upper portion and shoulder joint cap. The epaulet is adapted to contact the chest protector front portion. A neck pad is fixed to an inner margin of the arch portion of the chest protector.

19 Claims, 1 Drawing Sheet

PROTECTIVE ATHLETIC EQUIPMENT

BACKGROUND OF THE INVENTION

This invention relates generally to athletic equipment and more particularly to protective equipment for use in sports which allows for greater flexibility of movement, is cooler to wear, and affords enhanced protection.

Protective athletic equipment generally includes a number of separate portions secured together in order to provide protection for the particular part of the body concerned. Most portions of the equipment include a padded inner layer intended to come in contact with the player's body intended to absorb and spread the impact of any contact with other players, objects, etc. While the padded layer has in the past been formed of a porous fabric or other material stuffed with an orlon or ensolite batting, in recent years, the padded layer has often been made of a closed-cell elastomeric vinyl or other plastic foam having a smooth outer surface. The padded layer was often enclosed in a stretch polyester or nylon fabric cover which typically had no water wicking capability. Another type of padded layer commonly used in recent years in "nothing foam" which is an open-cell foam of very light weight enclosed in a substantially waterproof envelope having a generally smooth surface. The substantially smooth surfaces of the such padded layers inhibits any flow of air to the body of the player thereby preventing natural evaporation of perspiration, and contributing to body heat built-up.

In protective athletic equipment specifically designed for contact sports, such as shoulder pads conventionally designed for use in football, hockey, etc., each of the portions of the protective athletic equipment is typically constructed to include a hard, substantially rigid, shape-retaining outer surface layer. The outer substantially rigid shape retaining layer of such athletic equipment has on occasion caused injury to the person wearing the equipment. In particular, certain neck lacerations have been suffered by the players where a shoulder pad has been suddenly impacted from the side thereby pushing an inner edge against the neck causing a brief concentrated blow to the neck area. The outer edge of an upper portion of the chest protector has also caused injury principally to the biceps muscles when the arms are brought to a directly forward position. In football this injury to the biceps is due in part to a change in rules which permits offensive linemen to use their hands during blocking. This type of offensive blocking results into players extending their arms to a position nearly parallel to the ground or playing surface. During such extension, the contact between the biceps and outer edge of chest protector occurs and any sharp blow to the outer surface of the arm when in that position can cause significant injury to the arm.

It is therefore an object of the present invention to provide protective athletic equipment having padding of a design superior to that conventionally used which will provide the desired protection yet provide greater comfort of the wearer of such equipment. It is also an object of the present invention to provide a shoulder pad which is cooler to wear and which has a diminished likelihood of either neck injury or biceps injury due to impact with an edge of the shape retaining portion of pad.

SUMMARY OF THE INVENTION

An article of protective athletic equipment, adapted to be worn by a person, in accordance with the present invention, preferably includes a layer of closed cell elastomeric foam having a regularly bi-directionally convoluted (sinusoidal) first surface confronting the person. Means is provided for coupling the layer to the person for protection during athletic activity. The surface convolutions of the foam have an amplitude of between about 0.5 cm and 3 cm and have a periodicity of between about 1 cm and 10 cm. The layer of elastomeric foam having the regularly bi-directionally convoluted (sinusoidal) surface can be coupled to a second layer of foam of the same or different density, or can be coupled to a layer of substantially rigid shape-retaining material. The convoluted foam is preferably made from vinyl-nitryl, cross-linked polyethylene, polypropylene, polyurethane, or polyvinylchloride, or other closed cell foam plastics, preferably exhibiting a water absorption of less than about 1 percent. The convoluted foam is preferably enveloped in a porous or mesh material which will contribute to the free flow of air adjacent to the body of the wearer of such equipment.

An exemplary article of protective athletic equipment constructed in accordance with this invention is in the nature of a shoulder pad which includes a chest protector portion and means for coupling the chest protector to a person for protection during athletic activity. The chest protector includes a substantially rigid shape-retaining outer layer having a back portion, an arch portion over the shoulder area, and a front portion. The front portion includes outside edges proximately overlying a vertical mid-line of each pectoralis major of the person so that forward motion of the shoulder is unrestricted by the chest protector. The outside edge of the chest protector extends downwardly and outwardly below the pectoralis major to a lower margin to provide enhanced protection for the ribs. A flexible pad in accordance with this invention is coupled to the shape-retaining portion and extends outwardly over the outer portion of the pectoralis major to provide protection from impact. A hinge means coupling each flexible pad to the outside edge of the chest protector is provided so that a flexible pad can pivot about the outside edge during forward and rearward motion of the shoulder.

In a preferred embodiment, a shoulder pad constructed in accordance with this invention includes a shoulder joint cap having a padded inner portion and a substantially rigid outer portion flexibly connected to the arch portion of the chest protector. A substantially rigid flap or epaulet is flexibly connected to the rigid portion of the chest protector and overlies the junction of the chest protector upper portion and shoulder joint cap. The epaulet includes a lower front portion which overlies the flexible pad hinged to the outside edge of the chest protector and the chest protector front portion during impact of the shoulder with the arm down adjacent to the body thereby dispersing the blow over a wider body area. When the arm is raised significantly so as to move the shoulder joint cap upward, the flap or epaulet is pivoted so that the lower front portion is positioned over the flexible pad hinged to the outside edge of the chest protector and in front of the arm-clavical joint to absorb any shock sustained.

One advantage of athletic equipment constructed in the matter of the present invention is that the regularly bi-directionally convoluted (sinusoidal) surface of the padding material enhances circulation of cool air thereby permitting the natural evaporation of perspiration during athletic activity. The bi-directionally surface convoluted padding material exhibits a superior impact reduction as compared to padding material of the prior art. The incorporation in a shoulder pad of a pectoral hinge portion to reduce interference between the upper arm and the pectoral area of the chest protector has the advantage of significantly lowering the injury to biceps. The incorporation of a neck bumper pad attached to the rigid portion of the arch of the chest protector has the advantage of reducing the incidents of cuts and abrasions to the neck area. The presence of the lower front portion of the epaulet over the pectoral hinge portion has the advantage of reducing arm-clavical shoulder joint injuries and also may contribute to a lowering of collar bone injuries.

Additional features and advantages of protective athletic equipment constructed in accordance with the present invention will become apparent to those skilled in the art upon consideration of the following detailed description of a preferred embodiment exemplifying the best mode of carrying out the invention as presently perceived. The detailed description particularly refers to the accompanying figures.

DESCRIPTION OF THE PREFERRED EMBODIMENT

Figure 1:
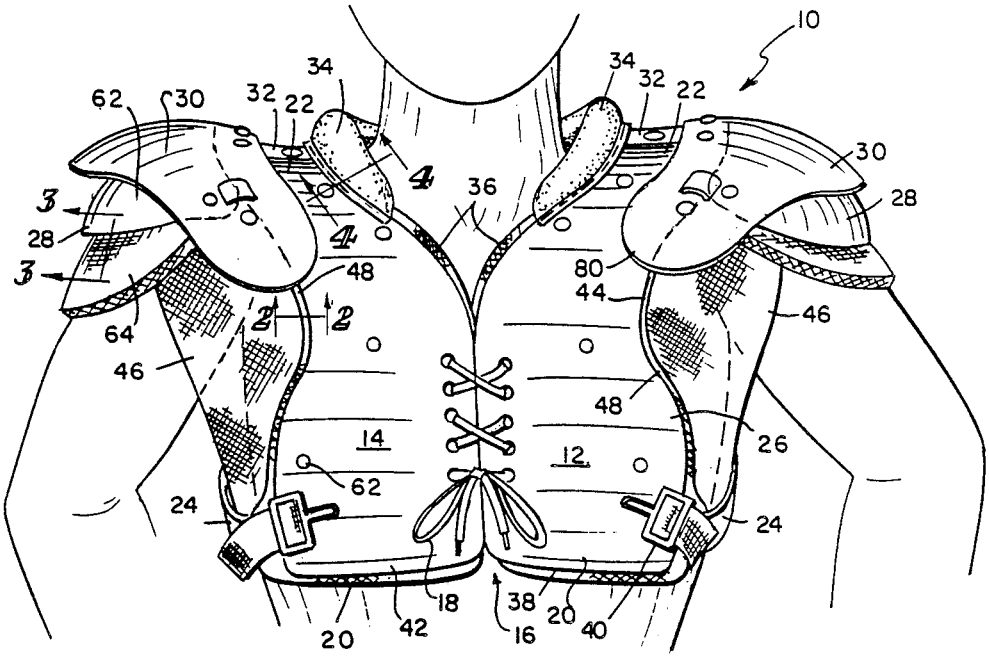
FIG. 1 is a perspective view of an article of athletic protective equipment in accordance with this invention as it would ordinarily be worn by a person.

An article of protective athletic equipment 10 in accordance with this invention is shown in FIG. 1 as it would ordinarily be worn by a person when playing football, hockey, or other contact sports. The article 10 generally comprises a left member 12 adapted to fit over the left half of the chest, and left shoulder. A corresponding right portion 14 is adapted to be worn over the right half of the chest and right shoulder. The left and right members 12 and 14 are shown to converge along a mid-line 16 generally overlying the sternum and are fastened together by an appropriate fastener 18 such as laces, straps, or the like.

The left member 12 and right member 14 together form a chest protector 26 which consists of a front portion 20, an arch portion 22 which extends from the front of the body over onto the back of the body, and a back portion (not illustrated). The back portion generally extends downward to a point approximately equal with the lower margin 38 of the front portion. In addition to the chest protector, the illustrated protective equipment 10 also includes a shoulder joint cap 28 and a flap or epaulet 30 each of which are flexibly connected to the chest protector by an appropriate hinge means such as the strap 32. A neck pad 34 is provided on an inner edge 36 of the chest protector to reduce any injury which might occur as a result of contact between the inner edge 36 of the chest protector and the neck. Side straps 24 fixed to the back portion of the chest protector extend around each side of the wearer's body and releasably engage the front portion 20. The straps can include adjustment means 40 to allow for variations in overall chest circumference.

The chest protector 20 includes a substantially rigid, shape-retaining outer layer 42 including an outside edge 44. The outside edge 44 approximately overlies a vertical mid-line of each pectoralis major and then extends downwardly and outwardly below the pectoralis major to provide protection for the middle rib cage. A flexible pad 46 is coupled to the shape retaining portion 42 and extends outwardly over the outer portion of the pectoralis major and can extend, as shown, slightly beyond the lateral margin of the body. A hinge line 48, which can consist of two or three lines of stiching, couples the flexible pad 46 to the chest protector 26.

Figure 2:
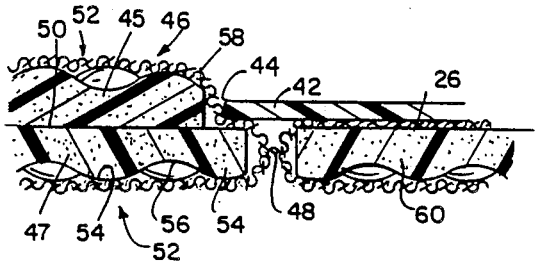
FIG. 2 is a sectional detail view taken along line 2—2 of FIG. 1.

In the preferred embodiment illustrated in section in FIG. 2, the pad 46 comprises two layers 45 and 47 each layer consisting essentially of a closed cell, elastomeric foam having a generally plane surface 50 and a regularly bi-directionally convoluted (sinusoidal) surface 52. The two layers 45 and 47 are bonded to each other on the confronting surface 50. The surface convolutions forming surface 52 comprise a series of mounts 54 and pockets 56 which are shown to be generally sinusoidal in cross section but extend over the entire surface 52 so as to be by-directionally sinusoidal. The convolutions preferably have an amplitude of between about 0.5 cm and 3 cm and have a periodicity, that is, distance between peaks, of between about 1 cm and 10 cm. The pad 46 is shown to be enveloped in a fabric covering 58 which fabric can be that conventionally used in such athletic equipment. A pad 60 of the same flexible construction as single layer 47 is advantageously used on the inside of the chest protector 26. The pad 60 can be adhered to the outer layer 42 of the chest protector by conventional means such as rivets 62, or can be removably secured by means of snaps or fabric fasteners. The hinge line 48 is shown to be positioned slightly inside the outer edge 44 of the outer layer 42 so as to contact surface 50 of layer 47. This contact acts to further reduce contact between edge 44 and the biceps portion of the wearer's arm.

Figure 3:
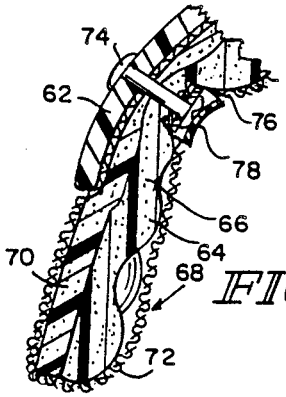
FIG. 3 is a sectional detail view taken along line 3—3 of FIG. 1.

The shoulder joint cap 28 shown in section in FIG. 3 also includes a substantially rigid shape-retaining outer portion 62 and a more flexible padded inner portion 64. The inner portion is shown to comprise a first layer of foam 66 having a bi-directionally convoluted surface 68 confronting the wearer of the protective equipment. A second layer 70 having no bi-directionally convoluted surface is bonded to the surface opposite the convoluted surface 68 of layer 66. The layer 70 preferably is of a closed cell foam of the same or slightly higher density than is layer 66. The layers 66 and 70 are in a fabric covering 72 and are secured to the outer portion 62 by fasteners such as rivets or snaps 74. The inner end 76 of fastener 74 includes a covering 78 generated from a single strip of plastic or other similar material, one end of the strip being pierced by the fastener 74 while the other end folds on top of the inner end 76 of the fastener. The inner portion 64 can of course be secured to the outer portion 62 of the shoulder joint cap by other means retaining the two portions in generally fixed relation to each other.

The epaulet 30 is shown to have a lower front portion 80 which overlies edge 44 of the chest protector 26 when the wearer of the equipment has the arms positioned as in FIG. 1. If the wearer of the equipment raises an arm thereby pivoting the shoulder joint cap 28 and epaulet 30 upward, the lower front portion 80 pivots to overlie only the pad 46 comprising the double layer of bi-directionally convoluted foam as previously described. Any frontal blow will cause portion 80 to come in contact with pad 46 thereby distributing the force of the contact over a wide area of the shoulder joint so as to lessen the tendency for injury.

Figure 4:
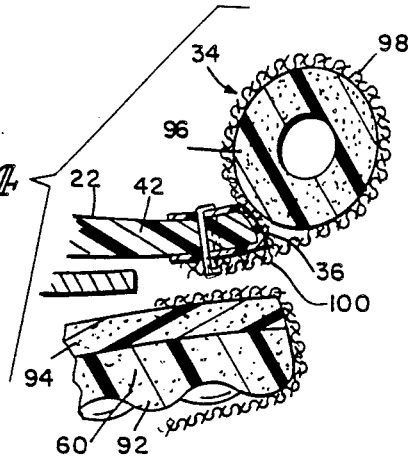
FIG. 4 is a sectional detail view taken along line 4—4 of FIG. 1.

FIG. 4 is a sectional view through the arch area 22 of chest protector 26 showing the substantially rigid, shape-retaining outer portion 42 spaced from the inner padding 60. This spacing is achieved in a known manner by providing a curved, relatively stiff member 90 on the underside of, and spaced from, the outer portion 42 near the top of the arch. The curved stiff member 90 is fixed to the back and front portions of the chest protector by fasteners. The stiff member 90 can most conveniently be made from aluminum or stainless steel strap or other similar material having sufficient strength to withstand repeated shock due to impact during play. The padding 60 is illustrated to comprise a first layer 92 and second layer 94 similar in construction to first layer 66 and second layer 70 of the shoulder joint cap illustrated in FIG. 3. A neck pad 34 is shown fixed to the substantially rigid, shape-retaining outer portion 42, and comprise a tubular element 96 formed of a closed cell elastomeric foam enveloped in a fabric outer layer 98. The fabric outer layer is secured to the underside 100 of the inner margin 36.

The illustrated preferred embodiment of the invention is shown to use a foam pad having a surface confronting the wearer of the athletic equipment with a regularly bi-directionally convoluted surface which acts to prevent clinging of the pad to the user's body and thereby inhibits any built-up body heat and excessive perspiration which might possibly contribute to heat exhaustion of the player. The convoluted surface has the advantage of reducing the overall weight but without sacrificing any of the shock absorbency capability of the foam. The bi-directionally convoluted surface thus contributes to both the comfort and performance of the person wearing the equipment. The added features of the hinged pad covering in the pectoral area of the body give the wearer of the pad considerable more freedom, particularly during maneuvers requiring forward extension of the arms and provides enhanced protection to the shoulder joint and biceps.

Although the invention has been described in detail with reference to the illustrated preferred embodiment, it will be appreciated that the regularly bi-directionally surface convoluted foam can be used in other protective athletic equipment not specifically described herein, and that other variations and modifications exist within the scope and spirit of the invention as described and as defined in the following claims.

What is claimed is:

1. An article of protective athletic equipment comprising: a first layer of substantially rigid, shape-retaining material, means for coupling the first layer to a person for protection during athletic activity, and a second layer fixed to the first layer for contact with the person, the second layer comprising a closed cell, elastomeric foam having a first surface confronting the first layer and a second regularly bi-directionally convoluted generally sinusoidal surface confronting the person.

2. The article of claim 1 wherein the surface convolutions of the second layer second surface have an amplitude of between about 0.5 cm and 3 cm.

3. The article of claim 1 wherein the surface convolutions of the second layer second surface have a periodicity of between about 1 cm and 10 cm.

4. The article of claim 1 wherein the second layer foam exhibits a water absorption of less than 1%.

5. The article of claim 1 wherein the second layer foam is selected from vinyl-nitryl, cross-linked polyethylene, polypropylene, polyurethane, and polyvinyl chloride.

6. The article of claim 1 further comprising a third layer situated between the first and second layers, the third layer comprising an elastomeric foam.

7. The article of claim 6 further comprising a fourth layer covering the second layer convoluted surface comprising a porous fabric.

8. The article of claim 1 further comprising a plurality of fasteners penetrating the first and second layers, each fastener including an inner and an outer end, and a like plurality of elongated covering strips each covering strip having a first end penetrated by one of the fasteners and a second end folded over the covering strip first end and fastener inner end.

9. An article of protective athletic equipment adapted to be worn by a person comprising: a layer of closed cell, elastomeric foam having a regularly bi-directionally convoluted generally sinusoidal first surface, and means for coupling the layer to the person for protection during athletic activity so that the first surface is confronting the person.

10. The article of claim 9 wherein the surface convolutions have an amplitude of between about 0.5 cm and 3 cm and a periodicity of between about 1 cm and 10 cm.

11. The article of claim 9 further comprising an additional layer of an elastomeric foam bonded to a surface opposite the bi-directionally convoluted first surface.

12. The article of claim 11 wherein the additional layer also includes a bi-directionally convoluted surface.

13. The article of claim 11 wherein the additional layer comprises a pair of parallel planar surfaces.

14. The article of claim 9 further comprising a porous fabric enveloping the layer of foam.

15. An article of protective athletic equipment comprising: a chest protector, and means for coupling the chest protector to a person for protection during athletic activity, the chest protector including a substantially rigid, shape-retaining portion comprising a back portion, and arch portion and a front portion including outside edges proximately overlying a vertical mid-line of each pectoralis major of the person so that forward motion of the shoulder is unrestricted by the chest protector, said outside edge extending downwardly and outwardly below the pectoralis major to provide protection for the ribs, separate flexible pads coupled to the shape-retaining portion and extending outwardly over the outer portion of the pectoralis major for protecting the outer portion of each pectoralis major, and hinge means coupling each separate flexible pad to said outside edge so that the separate flexible pad can pivot about said outside edge during movement of the shoulder.

16. The article of claim 15 further comprising a shoulder area pad including a shoulder joint cap having a padded inner portion and a substantially rigid outer portion flexibly connected to the arch portion of the chest protector, a substantially rigid epaulet flexibly connected to the arch portion of the chest protector to overlie the chest protector upper portion and shoulder joint cap, the epaulet including a lower frontal portion adapted to overlie the outside edge of the chest protector front portion.

17. The article of claim 16 further comprising a neck pad fixed to an inner margin of the arch portion of the substantially rigid, shape-retaining chest protector, and extending inward and upward therefrom.

18. The article of claim 17 wherein the chest protector comprises a layer of closed cell, elastomeric foam having a first surface confronting the substantially rigid, shape-retaining portion and a second regularly bi-directionally convoluted generally sinusoidal surface confronting the person.

19. The article of claim 18 further comprising a plurality of fasteners penetrating the foam layer and the substantially rigid portion, each fastener including an inner and an outer end, and a like plurality of elongated covering strips each covering strip having a first end penetrated by one of the fasteners and a second end folded over the covering strip first end and fastener inner end.

* * * * *